United States Patent [19]

Bartels

[11] 4,079,605

[45] Mar. 21, 1978

[54] OPTICAL KEY READER FOR DOOR LOCKS

[75] Inventor: Vernon A. Bartels, Alameda, Calif.

[73] Assignee: Schlage Lock Company, San Francisco, Calif.

[21] Appl. No.: 682,821

[22] Filed: May 3, 1976

[51] Int. Cl.[2] ..... E05B 47/00

[52] U.S. Cl. ..... 70/277; 70/DIG. 51; 356/71

[58] Field of Search ..... 70/277, 278, DIG. 51; 356/71; 235/61.11 E; 340/274 C, 149 A; 317/134; 250/569

[56] References Cited

U.S. PATENT DOCUMENTS

| | | | |
|---|---|---|---|
| 3,201,961 | 8/1965 | Williams et al. | 70/277 |
| 3,344,629 | 10/1967 | Burney | 70/277 X |
| 3,622,758 | 11/1971 | Schanne | 235/61.11 E |
| 3,673,569 | 6/1972 | Hedin et al. | 70/278 X |
| 3,732,465 | 5/1973 | Palmer | 317/134 |
| 3,735,096 | 5/1973 | Knockeart et al. | 235/61.11 E |
| 3,751,718 | 8/1973 | Hanchett | 317/134 |
| 3,769,514 | 10/1973 | Clark | 70/DIG. 51 |
| 3,797,936 | 3/1974 | Dimitriadis | 70/277 X |
| 3,818,444 | 6/1974 | Connell | 235/61.11 E X |
| 3,866,173 | 2/1975 | Moorman et al. | 340/149 A |
| 3,889,501 | 6/1975 | Fort | 317/134 X |
| 3,919,527 | 11/1975 | Bowen et al. | 235/61.11 E |
| 3,926,021 | 12/1975 | Genest et al. | 70/278 |

*Primary Examiner*—Roy D. Frazier
*Assistant Examiner*—Rodney H. Bonck
*Attorney, Agent, or Firm*—Phillips, Moore, Weissenberger, Lempio & Majestic

[57] ABSTRACT

An optical key reader for door locks is disclosed including optical scanning means for detecting a code pattern on a key unit when the unit is randomly oriented in an area near a given surface; the detected code being then compared by comparator means with a predetermined code which is stored in the reader. If a match is found in this comparison, the comparator means generates an actuation signal which is coupled to an electrically-actuatable securing means to cause the securing means to allow access through a door.

17 Claims, 7 Drawing Figures

OPTICAL KEY READER FOR DOOR LOCKS

BACKGROUND OF THE INVENTION

1. Field of the Invention

The present invention relates in general to access control systems, and more specifically to an apparatus for optically reading key units having a code pattern thereon and allowing access when the proper code is detected.

2. Description of the Prior Art

It is well known that mechanical locks have security disadvantages in that these locks can be opened by unauthorized persons having some expertise in this field. Even most electromechanical locks that are presently available have not completely solved this problem. These units still require that an opening or slot be provided within which the key must be positioned before the lock will allow access. See, e.g., U.S. Pat. No. 3,797,936 issued to Dimitriadis on March 19, 1974. One system has been provided that allows remote sensing of a key without the need of a key slot or opening. This system detects the key as the key is brought into a zone containing an electromagnetic field. See, e.g., U.S. Pat. No. 3,732,465 issued to Palmer et al on May 8, 1973. However, such systems have tended to be electromagnetic noise sensitive, and have been found to be somewhat limited in terms of the number of code combinations available for use.

Optical scanning systems have been developed for optically reading keys. However, these systems have been found to have deficiences, as above, in terms of requiring a key slot. More importantly, even optical scanners having a surface and not a slot for a key require that the key be placed on the surface before scanning by the apparatus is possible. Optical scanners for reading printed code patterns on various objects without requiring that the codes have a particular orientation have only recently been developed (see, e.g. U.S. Pat. Nos. 3,662,758 issued to Schanne on Nov. 23, 1971; 3,676,645 issued to Fickenscher on July 11, 1972; 3,818,444 issued to Connell on June 18, 1974; and 3,735,096 issued to Knockeart on May 22, 1973). These scanners use a non-divergent or coherent light source such as a laser beam. Product identification is the only present application for such optical scanners known to the applicant. No optical reader for door access control has been found wherein the reading of an object having a code pattern thereon is allowed notwithstanding the randomness of the placement of the key unit with respect to the scanning surface.

SUMMARY OF THE INVENTION

The present invention is an apparatus for allowing controlled access through a door by means of optically sensing a code on a key unit, comparing that code with a predetermined code previously stored in the apparatus, and using a signal representing a match between the codes as an actuating signal that causes the door-securing means to allow the door to open. The present invention also may be used for controlling access to drawers, machines, turnstiles, etc.

It is therefore an object of the present invention to provide an optical key reader for door locks which includes an optical scanner for reading an optically encoded key unit, without requiring that the key unit be positioned in any specific orientation with respect to the scanner.

Another object of the invention is to take advantage of state-of-the-art optical code detection systems to create a unique means for securing entry through a door.

A further object of the invention is to provide a key reader for door locks wherein no slot or hole is provided whereby access to the lock mechanism can be obtained.

Another object of the invention is to provide an optical key reader for door locks wherein the wrong code can activate either an audible or silent alarm.

A further object of the present invention is to provide a key reader for door locks in which the key unit codes can be changed easily and inexpensively, both on the key unit and in the apparatus, and wherein the type of code used enables a very large number of different key combinations to be available for use.

Other objects and advantages of the present invention will become more readily apparent upon reference to the accompanying drawings and following description.

DESCRIPTION OF THE PREFERRED EMBODIMENT

Figure 1:
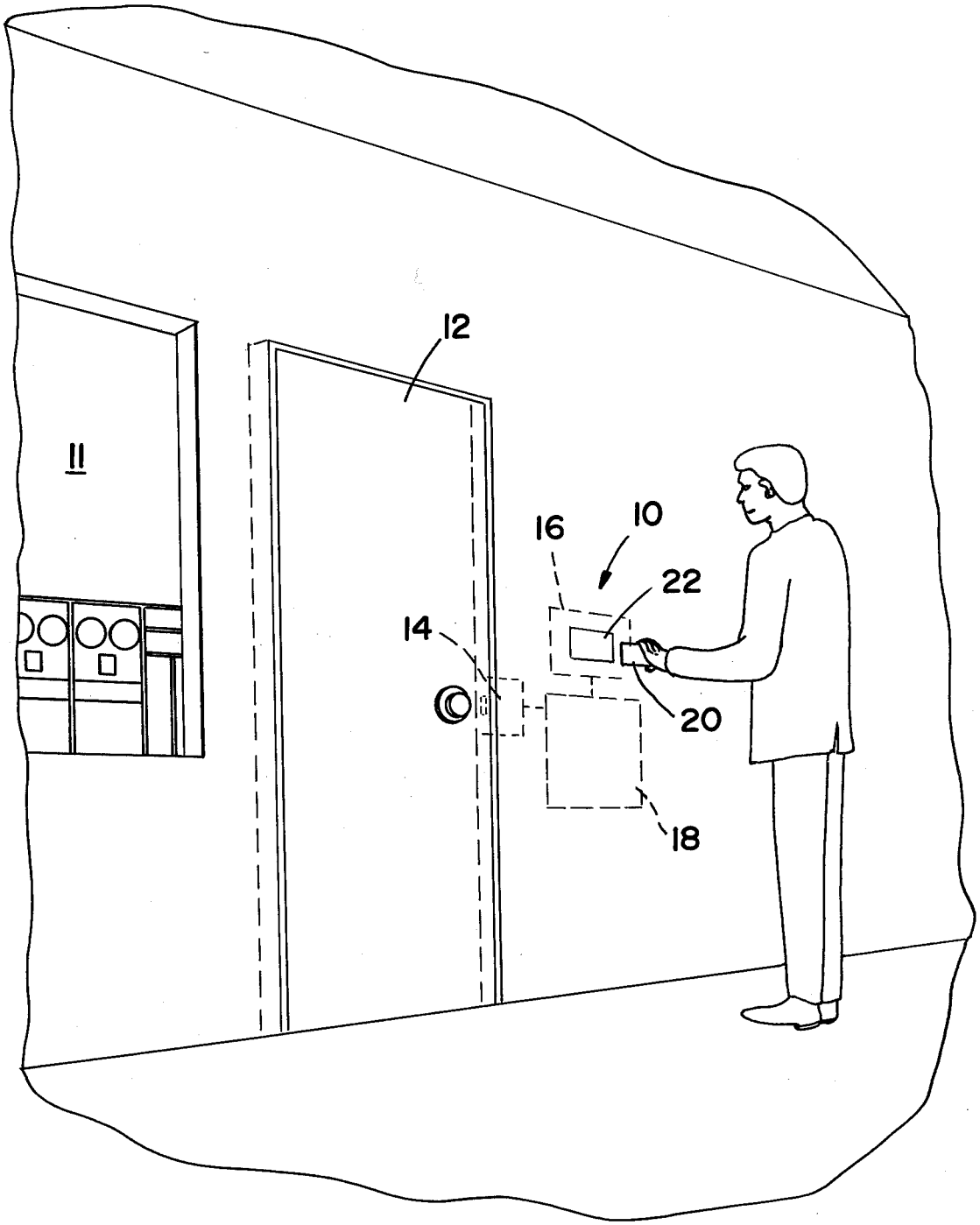
FIG. 1 is a schematic illustration of an installation of an optical key reader for door locks incorporating the teachings of the present invention.

FIG. 1 illustrates one application of the present invention. The apparatus is shown generally at 10. A door 12 provides access to a security area 11. This door 12 is held in place by an electrically actuatable lock 14 which acts to allow or disallow access therethrough. The lock 14 can be of any known type that is responsive to an actuation signal coupled to it, e.g., an electric knob lock, an electric strike or latch release, electromagnetic holding means, etc. The lock 14 of FIG. 1 illustrates the electric strike release version. Also shown in FIG. 1 is one arrangement of an optical scanner and sensor 16 including a light source 17 (see FIG. 2) and a controller 18. Note that the invention is not limited to this particular configuration. For example, the sensor 16 could be in the door itself, or remote from the door, or the controller 18 could be remote from the door. Thus, any special needs of a given user can be accommodated without requiring modification of the apparatus of the present invention.

In operation, a key unit, shown in the shape of a card 20, is brought within an area near a surface 22 that is substantially transparent and spaced such that it is between said light source 17 and any key unit 20, so that no unauthorized access from outside the security area 11 is allowed into the apparatus 10. A surface 22 also would give guidance to a card 20 user by defining an area where the optical scanning is enabled to occur. The optical scanner 16 detects a code pattern on the card 20 by rapidly scanning the area in front of the surface 22 by means of a beam of light generated by said light source 17, and at the same time monitoring the area for light that is reflected back. When a laser beam or other source of coherent light is used, the card 20 need not be positioned exactly at a certain point, since the light beam approximates parallel light having no focal point. Thus, when a surface 22 is provided, the card 20 can be positioned either on the surface 22 or at some distance off of the surface 22. Also, the code on the key unit need not be in a plane perpendicular to the beam generated by said light source 17. The code can be read at an angle off of this plane. Such an angle is a function of the width of the bars or circles in the code and a function of the diameter of the light beam. Up to 30° of shift off of the plane of the surface 22 is commonly allowed with presently-available scanners. Thus, as will be further explained below, a key unit that has a multiple number of identical printed codes on it on different faces of the key unit, or a key unit having rings extending the circumference of the unit with the unit in the shape of a cylinder or sphere, would enable any random orientation of the key unit in three-dimensional space to provide code readability for the optical scanner. In other words, so long as at least one code pattern on a key unit is within the viewing angle of the optical scanner 16, the key unit is not limited in its orientation with reference to the light source 17 or the surface 22.

A further characteristic of the scanner is that with the use of a coherent light source, such as a laser beam, a sufficient amount of light is reflected back through the scanner from the key unit to enable the read-out of the code pattern thereon at distances exceeding 6 inches away from the surface 22. Thus, a significant amount of freedom in the positioning of the key unit is allowed with the use of the optical scanner 16.

Figure 2:
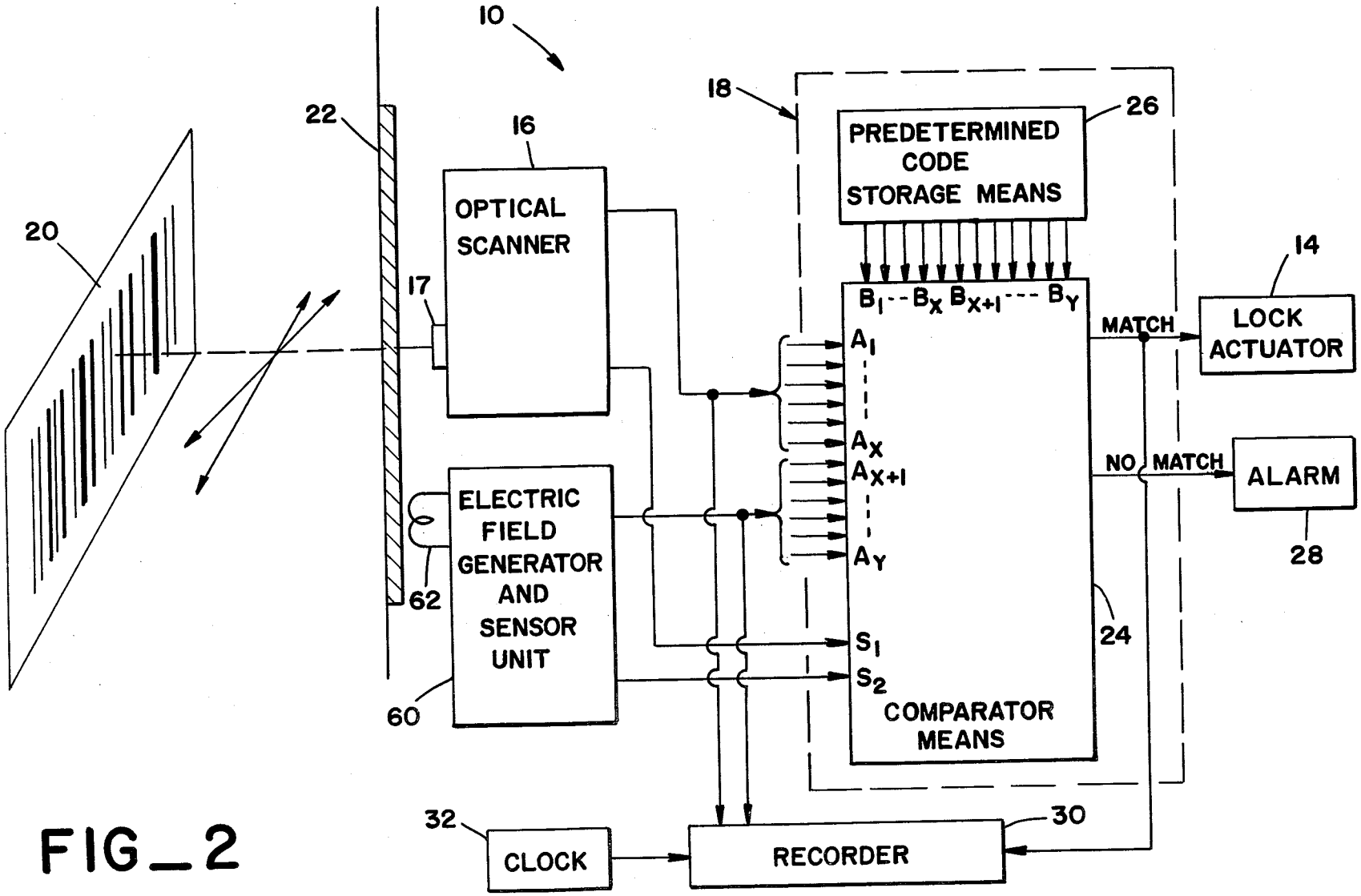
FIG. 2 is a functional block diagram of the optical scanner and electronic apparatus of the invention illustrated in FIG. 1.

FIG. 2 illustrates in more detail the key reader apparatus of FIG. 1. As is shown, a key unit in the shape of a card 20 has a code pattern thereon which is scanned by an optical scanner 16. The card 20 is scanned usually with respect to a surface 22. When a code has been detected by the optical scanner, the code is coupled to comparator means 24 in a controller 18. The controller 18 further includes a predetermined code storage means 26, which is also connected to the comparator means 24. The code received from the scanner 16 is compared in the comparator means 24 with the predetermined code stored in the storage means 26 and if a match is found to exist, an output signal is generated by the means 24 and coupled to the lock actuator 14. This signal functions as an actuation signal to cause the lock actuator, the electrically-actuatable securing means, to allow access through a door.

Optionally, when a code is detected by the scanner 16 and the comparator means 24 finds that it does not match the predetermined code, a second output from the comparator means 24 can be generated. With this output, one can activate either a silent or audible alarm 28. Another option is to provide a recorder 30 for use in keeping a permanent and complete record of the codes detected by the optical scanner 16. In addition, when a match is found by the comparator means 24, one can keep a permanent record of this occurrence. A conventional clock 32 can be added to the recorder 30 so that the time when each code detection has taken place in the optical scanner 16 can be recorded by the recorder 30. Thus, all accesses and attempted accesses through a door, or other secured openings or objects, can be kept track of with the recorder 30. Note that the present invention allows for a multiple number of scanners 16 to be used, with each one controlling access at a different door. The recorder 30, attached to such an apparatus, can also record the identity of a given door where an access or attempted access has occurred.

With reference more specifically to the operation of the present invention, the optical scanner 16 is preferably of the type currently used in supermarkets to read binary codes printed on products being purchased to enable product pricing and automatic inventory control. Such systems allow the binary codes printed on the products to be randomly oriented with respect to the surface of the reader. Such scanners commonly include a laser beam light source 17, a rotating mirror to generate scanning movement of the beam, and a photo-electric detector for detecting the light reflected back from the object being scanned. A filter is usually also needed to filter out ambient light so that only the light returning as reflected light from the laser beam is detected. The code printed on the product is normally a bar code comprising a plurality of parallel lines in a specific spaced relationship one with another, but this is merely because bar codes are more easily printed in an accurate manner than codes having other configurations. For example, a bull's -eye code is also equally readable by the scanner. The scan created by the rotating mirror may be a linear scan along two axes, as shown diagramatically in FIG. 2. This enables any orientation of the bar code to be readable by the scanner. The output of the photoelectric detector is analyzed to insure that each code is fully read and also properly read before any further analysis of the code is performed. The code is organized so that parity checking of the information is enabled. Also, usually two or more scans, resulting in an identical detection of the code, are required before further analysis of that code is enabled. The scanner lastly processes the code and outputs an electrical code equivalent thereto. Scanners, as described herein, were or are manufactured by International Business Machines, Inc. (IBM) and Identicon, Corp. of Franklin, Mass. , among others, and are thus well known in the art.

Thus, as shown in FIG. 2, the optical scanner 16 outputs its detected code to the comparator means 24. The preferred embodiment uses digital logic, i.e. logical "1's" and "0's", to convey the code as a binary word to the comparator means 24. Note, however, that the voltage level of an analog signal can also be used for this function. Note also that these codes can be connected as a parallel binary word via a plurality of data lines $A_1$. $-A_X$ or serially over one line. Either scheme is known to persons skilled in the art of digital electronics.

Within the controller 18, the predetermined code can be easily stored or modified if organized in binary form. For example, for ease of modifying a code, a plurality of two-state toggle switches can be used as modifiable storage means 26 for the predetermined code. If an analog signal is required, a simple potentiometer variable voltage source can be used to generate a plurality of different levels, i.e. "codes" required to match an analog code outputted by the optical scanner 16. A third possibility would be to use a perforated card or any other type of card having information corresponding to the desired predetermined code contained on it. Such cards would be read by a reader having the capability of reading that kind of card. In this case, either the reader itself or an adjacent unit could then act as the storage means 26. In the preferred embodiment, the predetermined code is a stored binary word which is connected to the comparator means 24 by a corresponding plurality of data lines $B_1$–$B_X$. Another alternative embodiment of the means 26 for storing the predetermined code is given herein below.

The comparator means 24 also can be a plurality of different structures. One embodiment would be to use a simple digital logic gate network to compare the binary word appearing on lines $A_1$–$A_X$ with the binary word appearing on lines $B_1$–$B_X$. An example of such an apparatus is given in FIG. 3. Note initially in FIG. 2 that a second line $S_1$ is connected from the optical scanner 16 to the comparator means 24. This signal serves to tell the comparator means 24 that a code has been detected by the optical scanner 16 and is ready for testing against the predetermined code. In a more complex embodiment, the comparator means 24 could make this determination independently by simple monitoring the input lines for the occurrence of any state changes, reflecting the fact that a new code is now appearing on the lines $A_1$–$A_X$.

Figure 3:
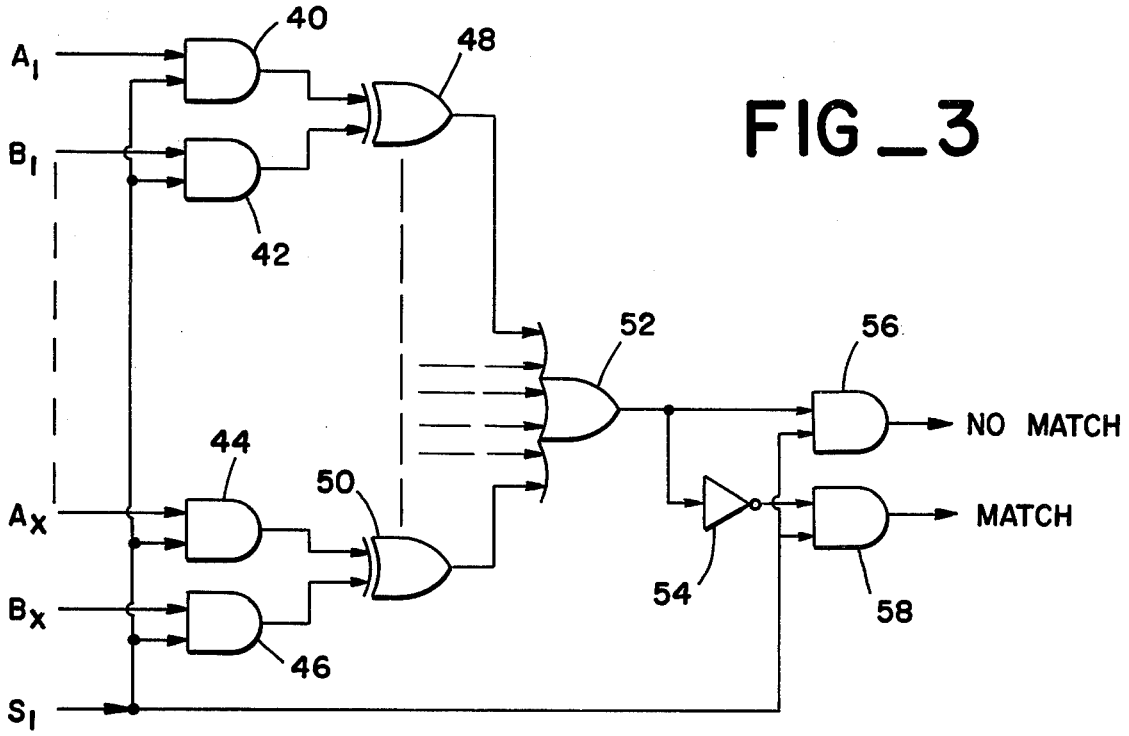
FIG. 3 illustrates an embodiment of the comparator means shown in FIG. 2.

Referring now to FIG. 3, line $S_1$ controls via AND gates, including gates 40, 42, 44 and 46, the time when the predetermined code is compared with the detected code from the scanner 16. Each corresponding bit of each of the codes is compared one with the other via an exclusive OR gate, such as the SN 7486, manufactured by Texas Instruments. This gate functions to give a logical "1" output only when the two inputs to the gate are at different states. Thus, for example, gate 48 in effect compares the first bit in the code from each of the two code words $A_1$–$A_X$ and $B_1$–$B_X$. If the bits match, there is a logical "0" output from gate 48, and if they do not match, a logical "1" is outputted therefrom. As can be seen, the comparison by every exclusive OR gate must give a logiccal "0" output to indicate thereby that the corresponding bits of two code words $A_1$–$A_X$ and $B_1$–$B_X$ match. Therefore, a simple OR gate for OR'ing together the output of the plurality of exclusive OR gates 48, 50, etc., is all that is needed for generating this indication, since if any of the exclusive OR gates give out a logical "1" indicating a bit mismatch, the OR gate will reflect this in its output to indicate a code word mismatch. Such an OR gate is shown as gate 52. Note that this comparator 24 is easily expandable to whatever length code word is desired. Adding further inputs to gate 52 is within the ordinary skill of the art. Since a logical "1" output for gate 52 indicates a mismatch, a logical "0" indicates that the codes match. To output a signal reflecting a match, an inverter 54 is added. AND gates 56 and 58 are needed to insure that a signal is outputted from the comparator means 24 only during the time that code words are being compared therein. The rest of the time, these outputs "NO MATCH" and "MATCH" should remain at a logical "0" level so that no erroneous actuation signal or alarm is generated therefrom.

One alternate embodiment of the present invention is to provide for the combined detection of an optically-scanned code and an electromagnetically-sensed code. An apparatus for providing this latter function is disclosed in U.S. Pat. No. 3,732,465. As shown in FIG. 2, such an electromagnetic sensor system 60, including an electric field generator and sensor antenna 62, could be combined with the apparatus previously described in FIG. 2 by merely adding corresponding bits to the predetermined code storage means 26 and expanding the comparator means 24, e.g. adding lines $A_{X+1}$–$A_Y$ and $B_{X+1}$–$B_Y$, to provide for the larger comparison. In this combination, the key unit would need to have added passive elements constituting the electromagnetic or frequency defined "code" for sensing by the unit 60. As disclosed in U.S. Pat. No. 3,732,465, such elements are able to be made as an integral part of a key card 20.

The latter apparatus combination is desirable, since in a similar way to the optical sensor 16, the electromagnetic sensor 60 does not need to have the key unit, the card 20, placed at a specific location for sensing a code therein. The card 20 need merely be brought into a sensing zone, including an electric field generated by the unit 60. Since the field generator and sensor antenna 62 component of the unit 60 is locatable either about or next to the transparent surface 22 of the optical sensor 16, the resultant combination allows for both codes to be read simultaneously without the card 20 being required to have any specific orientation with respect to the light source 17 and antenna 62. As a result, such a system would provide double security, in that even if the optical code pattern were copied, the electromagnetic frequency code is usable to prevent access. Similarly, copying only the electro-magnetic frequency code would also be insufficient to enable access. Also, the addition of a second code would expand by that factor the number of possible key combinations available. Note that a second line $S_2$ could be used to indicate to the comparator means 24 that an electromagnetic frequency code had been detected by the unit 60.

Figure 4:
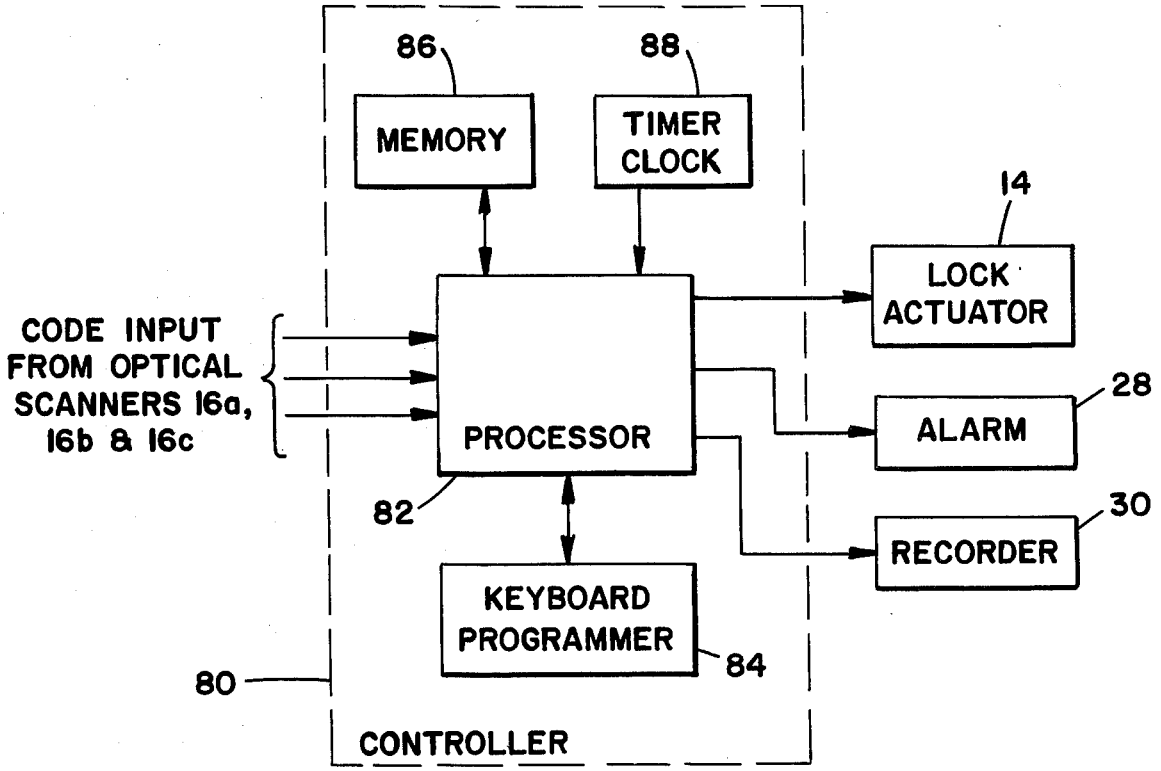
FIG. 4 illustrates a second embodiment of the key reader of the present invention.

A second alternate embodiment of the present invention is shown in FIG. 4. In this embodiment, a more sophisticated controller 80 is substituted for the controller 18 in FIG. 2. Specifically, the controller 80 would consist of a processor 82, a keyboard programmer 84, a memory 86, and, as an option, a timer clock 88. The rest of the apparatus, e.g. the lock actuator 14, would be the same as in the apparatus of FIG. 2. Controllers of this type are known and are common in the art. A controller having the above-described components for use with an electromagnetic sensor of the type described above is the Model 414 Access Control System, manufactured by Schlage Electronics, Inc. With the availability of a memory 86 having a plurality of words of storage, more than one code can be stored in the apparatus. Thus, the processor 82 need merely search through the plurality of predetermined codes stored in the memory 86 to determine if a code detected by the scanner 16 matches any one of these stored codes. As a result, each employee needing access to a door, as at 12 in FIG. 1, could be issued a key card 20 having a different code pattern thereon. Such a system would also allow a plurality of scanners 16, i.e. scanners **16*a*, 16*b*, and 16*c* in FIG. 4, to be controlled by the one controller 80. Such a system would include the allowance of one key card 20 to operate one door but not another, or similarly provide for a master keying scheme wherein certain key cards 20 have codes enabling access to more than one or to all doors whose access is controlled by scanners 16**.

A masterkeying scheme may be set up in a variety of different ways and still be of a form that enables storing of the masterkeying codes in a predetermined code form. One example would be to create a code having a plurality of sections. One would then be able to allocate one section of the code for the access control combinations. A second section of the code would contain the master combinations. Different levels of masterkeying would also be possible with this scheme. Thus, some masterkey units would be arranged such that they only open one set of doors, whereas a second set of masterkey units could allow access to the above set of doors and, in addition, allow access to a second set of doors or merely to said second set of doors. An illustration of one means for creating a coded masterkeying scheme in mechanical locks is disclosed in U.S. Pat. No. 3,348,392 issued to Schreiber on Oct. 24, 1967.

The availability of a timer clock 88 enables the control of door access as a function of the time of day, with, for example, certain codes allowing access during only the day shift, or allowing access only on certain days of the week, etc.

The keyboard programmer 84 provides means for easily inputting allowed door access codes into the memory 86 under the control of the processor 82 or for modifying codes already stored therein. Note that other means are also within the state of the art to provide such inputting of information, including a paper tape or card reader, etc. The keyboard 84 also can be used with the processor 82 to access a certain memory location in the memory 86 and display the current predetermined code stored therein. For example, the keyboard 84 can be used to modify allowed time zones for a given code, or to vary the authorization through certain doors, or, if a key card is reported as being stolen, enabling the code stored in the memory 86 corresponding thereto to be quickly voided so that any subsequent attempted access through a door using that key card 20 would result in the actuation of an alarm 28. The keyboard 84 could also easily be disconnected from the rest of the controller 80, and stored in a safe place to protect against unauthorized additions or deletions of codes in the apparatus 10.

One application of the apparatus of the present invention is as a means for controlling access to rooms in a hotel or motel. What would be desired is an automatic means for changing a lock combination for each new tenant. Note that a means for changing the lock combination would prevent unauthorized future access to a room by a person who has kept a key to that room or obtained such a key through theft. A non-automatic method for changing the lock combination would be as mentioned above, wherein one changes the allowed access code by modifying the predetermined code in the memory 86 by means of a keyboard 84. An automatic method would be where the code pattern on a key unit, such as a key card 20, would have two parts, e.g. a left half and a right half. When a new tenant is given a room, the key unit is organized such that the left half contains the access code of the previous tenant, and the right half contains the access code for the new tenant. Here access modification would be automatic, by use of a means for automatically modifying the predetermined codes. The processor 82 could be altered by means within the state of the art to enable this.

In operation, the latter method would require a maximum of two comparisons by the apparatus for each access attempt. The processor 82 would first compare the right half to determine whether the code on the key card 20 matches the predetermined code presently stored in the memory 86. If it does correspond, access is allowed. If, however, there is no match, the left half is checked by the proccessor 82 for a match. A match found here would indicate that a new tenant has been given a room. The processor 82 would then automatically erase the current predetermined code stored in the memory 86, and substitute therefore the new tenant's code as given in the right half of the card 20. As is seen, if the old tenant now attempts to gain access, his right-hand code, having been erased from the memory 86, will not allow access. Nor will the old tenant's leftside code allow access since it will not match the new predetermined code either. Thus, with this suggested method, no manual inputting of a new code via a keyboard 84 is required. Nor are any other manual steps required to update the predetermined code and thereby enable only the newest tenant to be allowed access to the room.

Figure 5A:
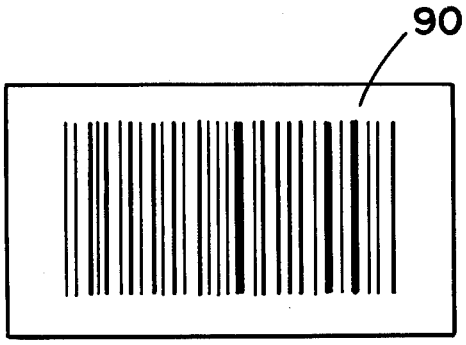
FIGS. 5A, 5B and 5C illustrate alternative key units for the apparatus of FIG. 1.
Figure 5B:
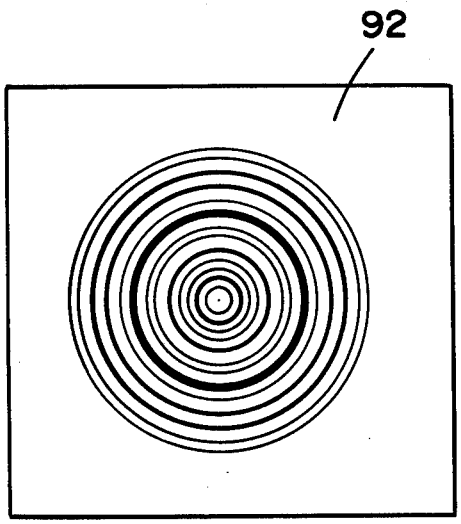
Figure 5C:
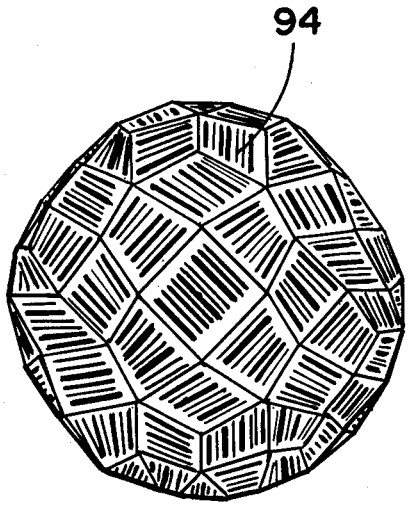

FIG. 5 illustrates representative alternative key units and codes usable with the apparatus of the present invention. FIG. 5 illustrates, at 5A, a key card 90 having a bar code pattern thereon. This card can be of any type desired, and need not be limited to coding according to the Uniform Product Code convention agreed upon between manufacturers. However, the code should provide for some parity checking means, including, for example, having the left half of the bar code be a mirror image of the right half. Another possible code configuration is shown in FIG. 5B, which illustrates a card 92 having a bull's-eye shaped code consisting of concentric circles of varied spacing. FIG. 5C is added to illustrate that the code need not be limited to being on a card, as in examples 90 and 92, but could be on other shapes as well, e.g. on a multi-sided shape 94. Such shapes would be desirable for the purpose of allowing a maximum of independence in the positioning of the key unit with respect to the optical scanner. It also illustrates that a user could custom design key units to meet his particular requirements, e.g. placing a bar code on a lapel badge, etc.

I claim:

1. An apparatus for controlling access comprising:

actuatable securing means;

a key unit having a code pattern thereon;

means for storing a predetermined code;

optical scanning means including a single coherent beam light source for detecting said key unit code when said key unit is three-dimensionally randomly oriented within a viewing area with respect to said light source, wherein said optical scanning means further comprises means for causing said beam to sweep a given area, photo-electrical detector means for detecting light reflected back from objects placed in the path of said beam, and data convertor means for outputting as an electrical signal a detected key unit code representing said key unit code pattern when said code pattern is detected by said optical scanning means;

comparator means operatively coupled to said storing means and connected to said optical scanning means for detecting when said key unit code matches said predetermined code and including means for generating an actuation signal in response thereto; and means for coupling said actuation signal to said actuatable securing means, such that said securing means is actuated thereby.

2. The apparatus of claim 1 further comprising a surface spaced between said light source and any said key unit for securing said light source from damage due to unauthorized access, and for providing a reference for the positioning of said key unit.

3. The apparatus of claim 1 wherein said means for storing a predetermined code further comprises means for modifying said predetermined code.

4. The apparatus of claim 1 further comprising recorder means wherein both the key unit code detected by said optical scanning means and the output of said comparator means are recorded for each said detected code.

5. The apparatus of claim 4 further comprising clock means such that the time of occurrence of each detected key unit code is recorded by said recorder means for each said detected code.

6. The apparatus of claim 1 wherein said key unit is in the shape of a card.

7. The apparatus of claim 1 further comprising alarm means for indicating when a detected key unit code does not match the predetermined code.

8. An apparatus for controlling access comprising:
actuatable securing means;
a key unit having a code pattern thereon;
memory means, including means for storing a plurality of predetermined codes;
a surface;
optical scanning means for optically detecting said key unit code when said key unit is positioned in a substantially spaced relationship to said surface, at a random orientation with respect thereto said optical scanning means comprising a single coherent beam light source, means for causing said beam to sweep a given area, photo-electrical detector means for detecting light reflected back from objects placed in the path of said beam, and data convertor means for outputting as an electrical signal a detected key unit code representing said key unit code pattern when said code pattern is detected by said optical scanning means;
processor means connected to said optical scanning means and said memory means for determining if said detected key unit code matches one of said plurality of predetermined codes stored in said memory means, and including means for generating an actuation signal in response to the occurrence of a said match; and
means for coupling said actuation signal to said actuatable securing means, such that said securing means is actuated thereby.

9. The apparatus of claim 8 further comprising timer means such that certain key unit codes are only recognized by said processor means as a function of the time of detection of said code.

10. The apparatus of claim 8 further comprising means for accessing said memory means to enable the modification of predetermined codes stored therein or for storing new predetermined codes.

11. The apparatus of claim 8 further comprising means for automatically modifying a given predetermined code wherein if said detected key unit code indicates that said given predetermined code is to be superseded by a new key unit code, said new key unit code having been read by said optical scanner means off of the same said key unit, said means for modifying said predetermined code is operatively enabled to cause said given predetermined code to be replaced in said memory means by said new key unit code which thereby becomes a new predetermined code.

12. The apparatus of claim 8 further comprising alarm means connected to said processor means for indicating when a key unit code has been detected which does not match any of the plurality of predetermined codes.

13. The apparatus of claim 8 further comprising recorder means connected to said processor means for recording each detected key unit code and for recording whether said code matches any of the plurality of predetermined codes.

14. The apparatus of claim 8 wherein said processor means further comprises means for recognizing a plurality of code sections on a given key unit, wherein each code section is compared with said stored predetermined codes, such that if any code section matches any of said predetermined codes, said means for generating an actuation signal is activated in response thereto.

15. An apparatus for controlling access comprising:
actuatable securing means;
a key unit having a code pattern thereon, and further including a field sensitive circuit having at least one selected resonant frequency;
means for storing a predetermined code;
a surface;
means for generating an electric field with respect to said surface such that as said key unit is three dimensionally randomly oriented with respect to said surface, said field generation means detects and outputs a code signal representative of the resonant frequency of said key unit;
optical scanning means including a single coherent beam light source positioned with respect to said surface for detecting said key unit code pattern when said key unit is three-dimensionally randomly oriented with respect to said surface, wherein said optical scanning means further comprises means for causing said beam to sweep a given area, photo-electrical detector means for detecting light reflected back from objects placed in the path of said beam, and data convertor means for outputting as an electrical signal a detected key unit code representing said key unit code pattern when said code pattern is detected by said optical scanning means;
comparator means connected to said optical scanning means and said electric field generation means for detecting when said key unit code pattern and the code represented by said resonant frequency on said key unit combine to match said predetermined code, and including means for generating an actuation signal in response thereto; and
means for coupling said actuation signal to said actuatable securing means, such that said securing means is actuated thereby.

16. An apparatus for controlling access comprising:
actuatable securing means;
a key unit having a code pattern thereon;
means for storing a predetermined code;
a surface;
optical scanning means for optically detecting said key unit code pattern when said key unit is positioned in a substantially spaced relationship to said surface, at a random orientation with respect thereto, said optical scanning means comprising a single coherent beam light source, means for causing said beam to sweep a given area, photo-electrical detector means for detecting light reflected back from objects placed in the path of said beam, and data convertor means for outputting as an electrical signal a detected key unit code representing said key unit code pattern when said code pattern is detected by said optical scanning means;
comparator means connector to said optical scanning means and operatively coupled to said means for storing a predetermined code, for detecting when said key unit code matches said predetermined code, and means for generating an actuation signal in response thereto; and means for coupling said actuation signal to said actuatable securing means, such that said securing means is actuated thereby.

17. The apparatus of claim 16 further comprising alarm means and means for storing a second predetermined code, wherein said alarm means is actuated by said comparator means when said comparator means detects that said key unit code matches said second predetermined code.

* * * * *

UNITED STATES PATENT OFFICE

CERTIFICATE OF CORRECTION

Patent No. 4,079,605 Dated March 21, 1978

Inventor(s) VERNON A. BARTELS, Assigned to: Schlage Lock Company

It is certified that error appears in the above-identified patent and that said Letters Patent are hereby corrected as shown below:

In column 4, lines 48-49:
"$A_{1-}-A_x$" should be --$A_1-A_x$--

In column 5, line 16:
"simple" should be --simply--

In column 5, line 34:
"logiccal" should be --logical--

In column 6, line 22:
"electro-magnetic" should be --electromagnetic--

In column 7, line 62:
"proccessor" should be --processor--

In column 7, line 66:
"therefore" should be --therefor--

In column 10, line 63:
"connector" should be --connected--

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*